US010434635B2

(12) United States Patent
Blum et al.

(10) Patent No.: US 10,434,635 B2
(45) Date of Patent: Oct. 8, 2019

(54) HANDHELD MACHINE TOOL

(75) Inventors: Jens Blum, Filderstadt (DE); Dietmar Saur, Gomaringen (DE); Tobias Herr, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 896 days.

(21) Appl. No.: 12/969,902

(22) Filed: Dec. 16, 2010

(65) Prior Publication Data

US 2011/0147030 A1 Jun. 23, 2011

(30) Foreign Application Priority Data

Dec. 18, 2009 (DE) ..... 10 2009 054 928
Jul. 13, 2010 (DE) ..... 10 2010 031 274

(51) Int. Cl.
*B25F 5/00* (2006.01)

(52) U.S. Cl.
CPC ..... *B25F 5/008* (2013.01)

(58) Field of Classification Search
CPC ..... B25F 5/008
USPC ..... 173/216–217
See application file for complete search history.

(56) References Cited

U.S. PATENT DOCUMENTS 2,155,082 A * 4/1939 Decker ..... B23B 45/001 173/216
3,003,073 A * 10/1961 Bixler ..... B23Q 11/127 310/59
3,511,322 A * 5/1970 Holman ..... B23Q 11/0046 126/25 A
3,919,574 A * 11/1975 Schmuck ..... B23B 45/02 310/239
4,763,031 A * 8/1988 Wang ..... 310/83
4,827,616 A * 5/1989 Sistare ..... 30/210
4,836,755 A * 6/1989 Nitsche ..... F04B 35/04 29/888.021
5,698,914 A * 12/1997 Shiga et al. ..... 310/60 A
5,779,589 A * 7/1998 Futterer ..... 475/346
5,818,142 A * 10/1998 Edleblute et al. ..... 310/239
5,868,208 A * 2/1999 Peisert ..... B23D 29/005 173/110
6,127,751 A 10/2000 Kristen et al.
6,325,157 B1 * 12/2001 Arakawa ..... B25D 16/00 173/117
6,369,470 B1 * 4/2002 Kylander et al. ..... 310/52
6,528,921 B1 * 3/2003 Nakane ..... B25F 5/02 310/235
6,543,549 B1 4/2003 Riedl et al.
6,557,648 B2 * 5/2003 Ichijyou ..... B25D 16/006 173/201
6,776,245 B2 * 8/2004 Kristen ..... B25D 17/20 173/109

(Continued)

FOREIGN PATENT DOCUMENTS

CN 101060958 10/2007
CN 101559588 10/2009

(Continued)

*Primary Examiner* — Robert F Long
(74) *Attorney, Agent, or Firm* — Norton Rose Fulbright US LLP; Gerard Messina

(57) ABSTRACT

A handheld machine tool, in particular a battery-driven handheld machine tool, having a gear unit and a cooling air unit. The cooling air unit is provided to route a flow of cooling air for cooling the gear unit past at least one gear element of the gear unit.

28 Claims, 4 Drawing Sheets

(56) References Cited

U.S. PATENT DOCUMENTS

| | | | | |
|---|---|---|---|---|
| 6,971,456 | B2 * | 12/2005 | Yamada et al. | 173/217 |
| 7,166,939 | B2 * | 1/2007 | Voigt | B25F 5/008 310/47 |
| 7,308,950 | B2 * | 12/2007 | Faatz et al. | 173/217 |
| 7,323,797 | B2 * | 1/2008 | Furui | B25F 5/008 310/47 |
| 7,330,006 | B2 * | 2/2008 | Iwata et al. | 318/400.41 |
| 7,705,497 | B2 * | 4/2010 | Arich et al. | 310/62 |
| 8,262,533 | B2 * | 9/2012 | Pedersen | 475/290 |
| 8,584,771 | B2 * | 11/2013 | Vollmer et al. | 173/217 |
| 8,672,049 | B2 * | 3/2014 | Tokairin et al. | 173/48 |
| 9,124,145 | B2 * | 9/2015 | Lau | H02K 9/06 |
| 9,126,320 | B2 * | 9/2015 | Shinma | B25D 17/20 |
| 9,808,872 | B2 * | 11/2017 | Yamaguchi | B23D 45/16 |
| 9,871,424 | B2 * | 1/2018 | Tadokoro | B25F 5/008 |
| 9,999,967 | B2 * | 6/2018 | Furusawa | B25D 17/043 |
| 10,286,529 | B2 * | 5/2019 | Kiyohara | B25B 21/00 |
| 2003/0127932 | A1 * | 7/2003 | Ishida | B25F 5/00 310/184 |
| 2004/0020671 | A1 * | 2/2004 | Lamprecht | B23Q 11/0046 173/217 |
| 2004/0124721 | A1 * | 7/2004 | Pfisterer | B25D 17/20 310/51 |
| 2004/0263008 | A1 * | 12/2004 | Voigt et al. | 310/58 |
| 2006/0000627 | A1 * | 1/2006 | Frauhammer | B25D 16/00 173/201 |
| 2006/0175915 | A1 * | 8/2006 | Voigt et al. | 310/58 |
| 2006/0290213 | A1 * | 12/2006 | Furui | B25F 5/008 310/58 |
| 2007/0056759 | A1 | 3/2007 | Aeberhard | |
| 2008/0092363 | A1 * | 4/2008 | Faatz et al. | 29/598 |
| 2009/0233754 | A1 * | 9/2009 | Pedersen | 475/296 |
| 2009/0245958 | A1 * | 10/2009 | Lau et al. | 408/125 |
| 2011/0001368 | A1 * | 1/2011 | Lau | 310/50 |
| 2013/0065727 | A1 * | 3/2013 | Saur | B25F 5/001 475/298 |
| 2014/0144663 | A1 * | 5/2014 | Fuchs | B25F 5/008 173/216 |

FOREIGN PATENT DOCUMENTS

| | | |
|---|---|---|
| DE | 1729542 | 9/1956 |
| DE | 196 00 339 | 12/1996 |
| EP | 1 759 813 | 3/2007 |
| GB | 2459191 | 10/2009 |

* cited by examiner

HANDHELD MACHINE TOOL

RELATED APPLICATION INFORMATION

The present application claims priority to and the benefit of German patent application no. 10 2009 054 928.5, which was filed in Germany on Dec. 18, 2009, and of German patent application no. 10 2010 031 274.6, which was filed in Germany on Jul. 13, 2010, the disclosures of which are incorporated herein by reference.

FIELD OF THE INVENTION

The present invention relates to a handheld machine tool, in particular a battery-driven handheld machine tool, having a gear unit and a cooling air unit.

BACKGROUND INFORMATION

Handheld machine tools having a gear unit and a cooling air unit are already known. The cooling air unit is provided in order to produce a flow of cooling air in order to cool an electromotor unit.

SUMMARY OF THE INVENTION

The exemplary embodiments and/or exemplary methods of the present invention are based on a handheld machine tool, in particular a battery-driven handheld machine tool, equipped with a gear unit and a cooling air unit.

It is proposed that the cooling air unit is provided in order to route a flow of cooling air past at least one gear element of the gear unit for the purpose of cooling the gear unit. In this context, "provided", in particular, means specially equipped and/or specially designed. The term "gear unit" in this instance specifically defines a mechanism which includes at least two components, in particular gear elements, which are provided in order to jointly modify an amount of a force, a torque and/or a rotational speed, and/or with whose aid a type of motion such as a rotation is able to be converted into a different type of motion, such as a translation. The components, especially the gear elements, may be implemented as toothed wheels and/or as shafts and/or as gearbox covers and/or as gearbox casings. In this context, "gearbox casing" is to be understood in particular as a casing that is provided for the purpose of accommodating gear elements and which is essentially enclosed by a handheld machine tool housing, especially in a shared plane, which essentially extends perpendicular to an axis of rotation of a tool holder of the handheld machine tool and/or to an axis of rotation of a gear element disposed inside the gear unit housing. In this instance, "cooling air unit" specifically denotes a unit that has at least one component, the component generating the flow of cooling air, for example, especially by generating a vacuum pressure, by which air for cooling purposes is aspirated through openings.

The expression "to route past at least one gear element of the gear unit" in this instance, in particular, is meant to define a routing of the stream of cooling air, in which the flow of cooling air directly adjoins at least one wall of the gear element, so that a heat transfer, via convection, is able to take place between the flow of cooling air and the gear element. The wall of the gear element may be realized by an outer wall of the gear element and/or by an inner wall of a cooling air channel disposed inside the gear element. The handheld machine tool according to the present invention may be implemented as a battery-driven, handheld machine tool, in particular one realized as battery-driven screw driller or battery-driven impact drill. The development of the handheld machine tool according to the present invention makes it possible to achieve cooling of the gear element and, via the gear element, advantageous cooling of the entire gear unit by the cooling air unit, in an uncomplicated manner in terms of construction. Furthermore, by cooling the gear unit, the service life of the gear unit is able to be increased in an especially advantageous manner since overheating of the gear unit, in particular of the cooled gear element, is able to be prevented in an advantageous manner.

The gear element may be developed as gearbox cover. In this context, the term "gearbox cover" is to specifically denote a component of the gear unit, which may be disposed in removable manner on the gear unit, especially a gearbox casing, by a screw connection, and which is provided in order to prevent the leakage of lubricant from the gear unit in conjunction with a seal. However, it is conceivable that the gearbox cover is mounted on the gear unit in some other removable manner via connection types previously known to one skilled in the art. During operation of the handheld machine tool, heated lubricant transmits heat from the gearbox to the gear unit cover, so that the design of the gear element as gearbox cover according to the present invention is especially advantageous because it makes it possible to dissipate heat from the gear unit.

Furthermore, it is proposed to realize the gear element as annulus gear of the gear unit implemented as planetary gear. The gear unit may be developed as multi-stage planetary gear. By switching between planetary gear stages of the gear unit, a step-down or a step-up ratio of a rotary speed and/or a torque produced by an electromotor unit of the handheld machine tool is therefore able to be achieved in an advantageous manner. In addition, it especially may be that if the gear element is implemented as annulus gear of a first planetary gear stage. The annulus gear of the first planetary gear stage is disposed along a main extension direction, which extends from a handle of the handheld machine tool in the direction of a tool holder of the handheld machine tool, downstream from the electromotor unit, especially downstream from the gearbox cover of the gear unit. However, it is also conceivable that the annulus gear is integrally formed with the gearbox cover. The term "integrally formed" in this instance specifically means constructed in one piece and/or formed from one cast and/or implemented as one component, which is able to be separated only by using a separation and/or cutting tool. The main extension direction essentially runs parallel to an axis of rotation of a tool holder of the handheld machine tool and/or to an axis of rotation of the gear element of the gear unit. In this instance, the expression "essentially parallel" specifically defines a direction which features a deviation of especially less than 8°, advantageously less than 5°, and especially advantageously, less than 2° relative to a reference direction. With the aid of the development of the gear element as annulus gear according to the present invention, a compact design and advantageous cooling of the gear unit are able to be achieved.

The handheld machine tool advantageously includes an electromotor unit, which has at least one shaft and at least one bearing support element for supporting a bearing of the shaft of the electromotor unit. In an especially particular manner, the bearing support element may be at least partially formed in one piece with the gear element. In one especially particular development of the handheld machine tool according to the present invention, the gear element is produced from a sintered material. Furthermore, in an alternative development of the handheld machine tool according to the present invention, it is proposed that the gear element is made from a zinc alloy. However, it is also conceivable that the bearing support element is formed by a component that is separate from the gear element. Different material combinations, which have a positive effect on an advantageous heat transfer, are conceivable for this purpose. In a gear element made from sintered material, the bearing support element may likewise be made from sintered material, or the bearing support element is made from an aluminum or a magnesium or a zinc alloy. In a gear element made from plastic, the bearing support element may also be produced from sintered material, or the bearing support element is made from an aluminum or a magnesium or a zinc alloy. Furthermore, in one additional development of the gear element, especially a gearbox cover, made from plastic, it is also conceivable that a heat-conducting element implemented as a drawn sheet metal part may be inserted into the gear element to dissipate heat. The heat-conducting element implemented as drawn sheet metal part may be situated along the axis of rotation of the tool holder of the handheld machine tool, and/or along the axis of rotation of a gear element, especially a toothed wheel, of the gear unit, between the gear element, especially a gearbox cover, and planetary wheels of the gear unit.

The bearing support element and/or the heat-conducting element implemented as drawn sheet metal part may advantageously serve as heat store or heat conductor, so that in the case of an integral development of the bearing support element and the gear element, or in the case of one of the aforementioned combinations of material types, an advantageous heat transfer away from the gear unit is able to be achieved in a separate implementation of the bearing support element and the gear element. Furthermore, through the development according to the present invention, cooling of the gear element, especially cooling of the entire gear unit, by approximately 20° C. is achievable in an especially advantageous manner, so that a service life of the gear element and a lubricant provided in the gear unit is able to be increased in an especially advantageous manner.

In addition, it is proposed that the handheld machine tool includes an electromotor unit, which has a fan wheel, which is at least partially formed in one piece with a fan wheel of the cooling air unit so as to generate the flow of cooling air for cooling the gear unit. In an especially particular manner, 20% of the entire flow of cooling air is used for cooling the gear unit, and 80% of the entire flow of cooling air is used for cooling the electromotor unit. With the integral formation of the fan wheel of the electromotor unit with the fan wheel of the cooling air unit, further components for cooling the gear unit are able to be dispensed with, which advantageously saves space, expense and installation outlay.

The handheld machine tool according to the present invention may include an electromotor unit, which has at least one rotor, the cooling air unit having at least one cooling air channel, which routes the flow of cooling air along a main extension direction between the rotor and the gear element. The term "cooling air channel" is meant to specifically denote a system and/or a construction method of components that is provided for the selective routing of the cooling-air flow. It is conceivable to place an air-conducting arrangement, such as air guide vanes, in particular, in the cooling air channel, which may be provided for the selective routing of the flow of cooling air and/or for generating turbulence in the flow of cooling air so as to produce a turbulent flow. This also makes it possible to selectively route the flow of cooling air to a heat source for the dissipation of heat, and/or to selectively route it past the heat source in an uncomplicated manner in terms of construction, so that a heat transfer by convection is advantageously able to take place. Thus, overheating of components is able to be counteracted in an advantageous manner.

In one exemplary development, the handheld machine tool has a handheld machine tool housing provided with at least one intake opening for cooling air, which is at least partially formed in one piece with the cooling air channel. The term "handheld machine tool housing" specifically is meant to define an outermost casing that encloses components of the handheld machine tool, so that the components of the handheld machine tool are essentially protected from external influences, the casing being provided to allow an operator of the handheld machine tool to handle and operate, especially guide, the handheld machine tool. The handheld machine tool housing may be made of a unit that encompasses at least two housing half-shells, which are joinable along a connection plane. The handheld machine tool housing may be made from a variety of materials that are deemed practical by the expert, such as a metal, a nonferrous metal etc., which may be from plastic. Using the configuration according to the exemplary embodiments and/or exemplary methods of the present invention, it is possible to use ambient air for the cooling, in particular for the cooling of the gear unit, in a simple manner in terms of construction.

In addition, it is proposed that the gear element is disposed along the main extension direction at least partially between a pinion situated on a shaft of the electromotor unit, and the rotor of the electromotor unit. In this context, "between" is meant to denote a spatial position of a component, in particular the gear element, between other components, especially the pinion and the rotor of the electromotor unit.

This advantageously makes it possible to use the flow of cooling air to cool the gear unit, in particular the gear element, and simultaneously to cool the rotor of the electromotor unit. Additional components for cooling the rotor are advantageously able to be dispensed with.

Further advantages are derived from the description of the figures that follows. The drawing shows exemplary embodiments of the present invention. The drawing, the description, and the claims include numerous features in combination. One skilled in the art will necessarily consider the features also individually and combine them into useful further combinations.

DETAILED DESCRIPTION

Figure 1:
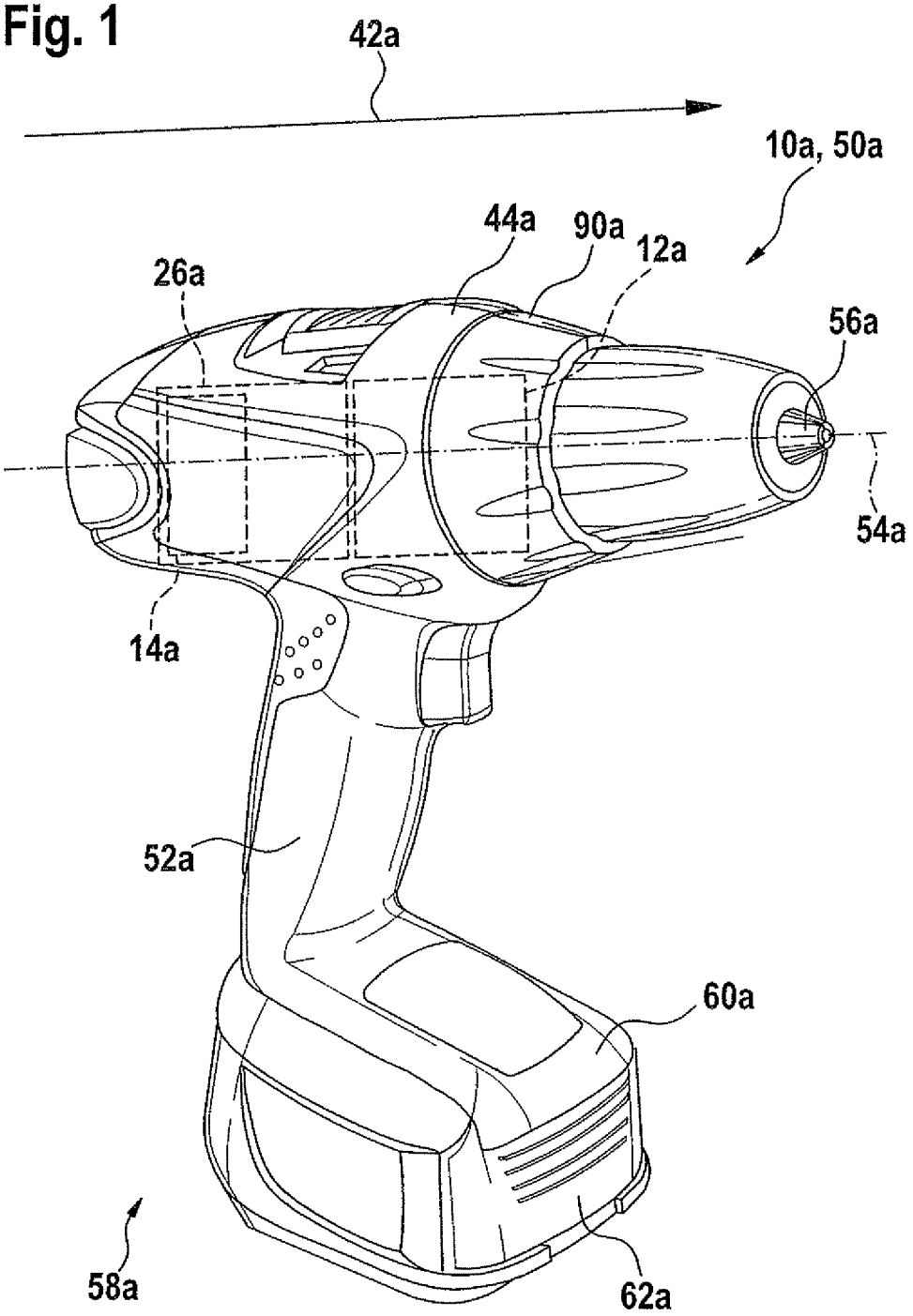
FIG. 1 shows a handheld machine tool according to the present invention, in a schematized illustration.
Figure 2:
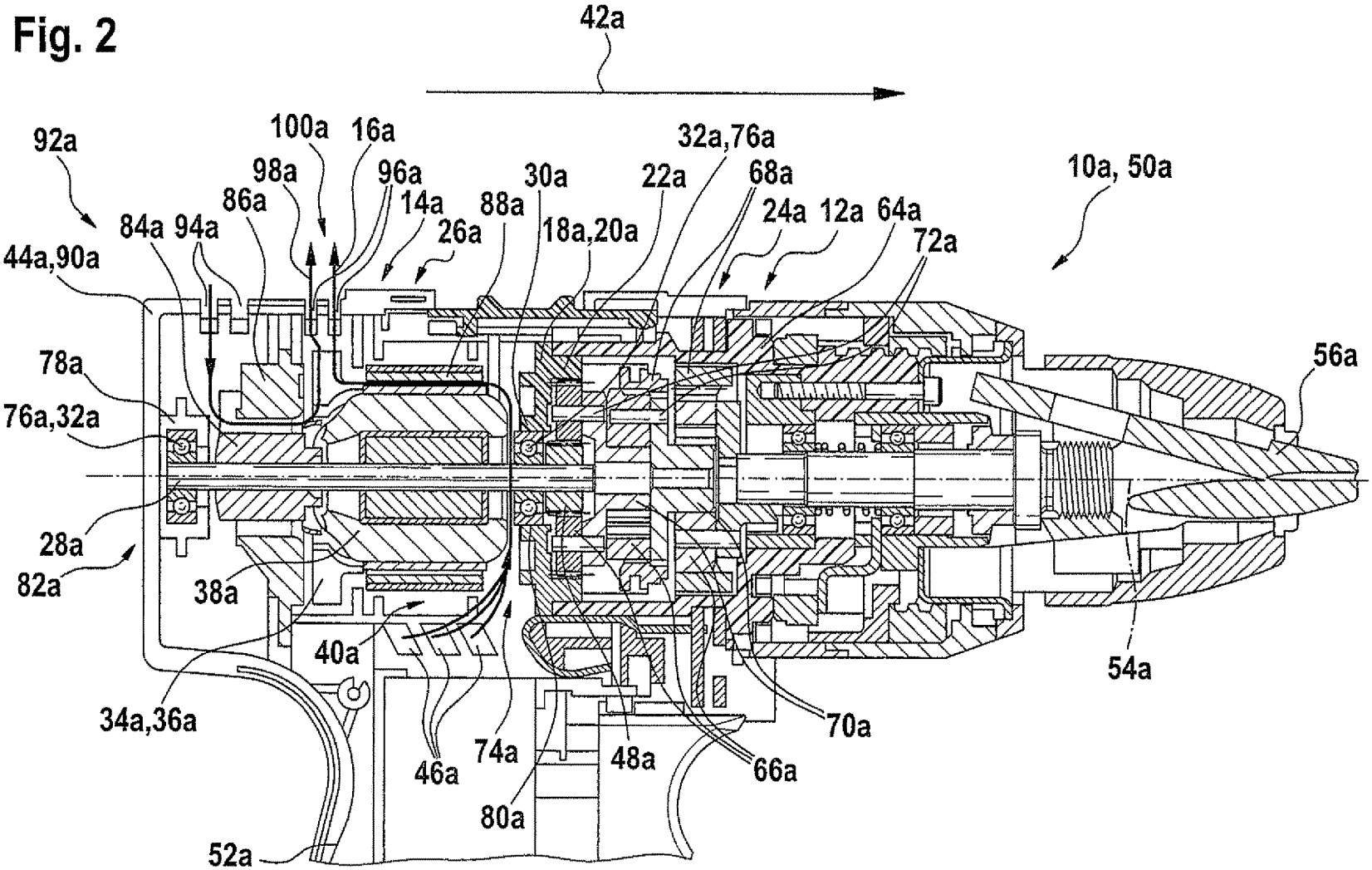
FIG. 2 shows a detail view of the handheld machine tool according to the present invention, showing an open handheld machine tool housing in a schematized illustration.

FIG. 1 shows a schematized illustration of a handheld machine tool 10*a* according to the present invention, which is implemented as battery-driven drill screwer 50*a*. Handheld machine tool 10*a* includes a gear unit 12*a* and a cooling air unit 14*a*. Cooling air unit 14*a* is provided in order to route a first flow of cooling air 16*a* for cooling gear unit 12*a* past a gear element 18*a* of gear unit 12*a* while handheld machine tool 10*a* is in operation (FIG. 2). Gear unit 12*a* is connected to an electromotor unit 26*a* of handheld machine tool 10*a* for the generation of a torque and/or a rotational speed. The generation of the torque and/or the rotational speed with the aid of gear unit 12*a* and electromotor unit 26*a* takes place in a manner that is already known to the expert, so that no detailed description will be provided here. Furthermore, handheld machine tool 10*a* includes a handheld machine tool housing 44*a* and a handle 52*a*, which extends perpendicular to a main extension direction 42*a* of handheld machine tool 10*a*. Main extension direction 42*a* extends parallel to an axis of rotation 54*a* of a tool holder 56*a* of handheld machine tool 10*a* provided for the purpose of accommodating a tool (not shown here). Handle 52*a* includes an accumulator receptacle 60*a* on a side 58*a* facing away from handheld machine tool 10*a*. Accumulator receptacle 60*a* is provided for holding an accumulator unit 62*a* for the energy supply of handheld machine tool 10*a*.

FIG. 2 shows a detail view of handheld machine tool 10*a* according to the exemplary embodiments and/or exemplary methods of the present invention, featuring an open handheld machine tool housing 44*a* in a schematized illustration. Handheld machine tool 10*a* includes a gearbox casing 64*a*, which is disposed inside handheld machine tool housing 44*a*. Gearbox casing 64*a* is sealed with the aid of gear element 18*a*, which is implemented as gearbox cover 20*a*. Gearbox casing 64*a* is provided in order to accommodate components of gear unit 12*a* and to support them. Gear unit 12*a* is developed as multi-stage planetary gear 24*a*. Thus, planetary wheels 66*a*, annulus gears 22*a*, 68*a*, a sun gear implemented as pinion 48*a*, or planetary supports 70*a* integrally formed with sun gears, and shafts 72*a* of planetary gear 24*a* are supported inside gearbox casing 64*a*. A method of functioning of gear unit 12*a* implemented as planetary gear 24*a* is already known to the expert, so that no further description will be provided here. In one exemplary development of handheld machine tool 10*a* according to the present invention, gear element 18*a* is implemented as annulus gear 22 of gear unit 12*a* developed as planetary gear 24*a*. Annulus gear 22*a* is integrally formed with gearbox cover 20*a*. Annulus gear 22*a* integrally formed with gearbox cover 20*a* constitutes annulus gear 22*a* of a first planetary gear stage of gear unit 12*a* implemented as planetary gear 24*a*. To reduce wear and friction in planetary gear 24*a*, a lubricant in the form of lubricating grease is provided inside gearbox casing 64*a*.

Electromotor unit 26*a* is disposed inside handheld machine tool housing 44*a* on a side 74*a* of gearbox casing 64*a* that is facing away from tool holder 56*a*. Electromotor unit 26*a* has a shaft 28*a*, which is supported in handheld machine tool housing 44*a* via bearings 32*a*. Bearings 32*a* are implemented as ball bearings 76*a*. To accommodate ball bearing 76*a*, handheld machine tool 10*a* includes a first bearing support element 30*a* and a second bearing support element 78*a*. First bearing support element 30*a* for accommodating one of ball bearings 76*a* of shaft 28*a* of electromotor unit 26*a* is disposed as axial recess 80*a* in gearbox cover 20*a*. Thus, first bearing support element 30*a* is integrally formed with gear element 18*a* implemented as gearbox cover 20*a*. Second bearing support element 78*a* is disposed in handheld machine tool housing 44*a* on a side 82*a* of electromotor unit 26*a* facing away from tool holder 56*a*. For the meaningful transmission of heat away from gear unit 12*a*, gear element 18*a* integrally formed with bearing support element 30*a* and annulus gear 22*a* of the first planetary gear stage and implemented as gearbox cover 20*a*, is made from sintered material. As an alternative, for the useful transmission of heat away from gear unit 12*a*, gear element 18*a* is made from a zinc alloy.

Furthermore, electromotor unit 26*a* has a rotor 38*a*, a commutator 84*a*, a fan wheel 34*a*, a sliding contact 86*a* implemented as carbon brushes, and a stator 88*a*. Rotor 38*a*, commutator 84*a*, and fan wheel 34*a* are mounted on shaft 28*a* in a torque-proof manner, so that a rotational speed of shaft 28*a* of electromotor unit 26*a* corresponds to a rotational speed of rotor 38*a*, commutator 84*a*, and fan wheel 34*a*. Sliding contact 86*a* implemented as carbon brushes, and stator 88*a* are supported in torque-proof manner inside handheld machine tool housing 44*a*. Thus, electromotor unit 26*a* is implemented as so-called open-frame motor, in which components of electromotor unit 26*a* are individually supported inside handheld machine tool housing 44*a*. Gear element 18*a* implemented as gearbox cover 20*a*, which is integrally formed with first bearing support element 30*a* and annulus gear 22*a* of the first planetary gear stage, is disposed along main extension direction 42*a*, between pinion 48*a* positioned on shaft 28*a* of electromotor unit 26*a*, and rotor 38*a* of electromotor unit 26*a*. Shaft 28*a* of electromotor unit 26*a* extends along main extension direction 42*a*, an end on which pinion 48*a* is disposed, projecting into gearbox casing 64*a*. Pinion 48*a* is in engagement with annulus gear 22*a* of the first planetary gear stage of gear unit 12*a*.

Fan wheel 34*a* of electromotor unit 26*a* is integrally formed with a fan wheel 36*a* of cooling air unit 14*a* in order to produce first flow of cooling air 16*a* for the cooling of gear unit 12*a*. In addition, cooling air unit 14*a* for cooling gear unit 12*a* has a cooling air channel 40*a*, which routes first flow of cooling air 16*a* along main extension direction 42*a* between rotor 38*a* of electromotor unit 26*a* and gear element 18*a* implemented as gearbox cover 20*a*, which is integrally formed with first bearing support element 30*a* and annulus gear 22*a* of the first planetary gear stage. Thus, first flow of cooling air 16*a* for cooling gear unit 12*a* is routed past gear element 18*a* implemented as gearbox cover 20*a* perpendicular to main extension direction 42*a*, which gear element is integrally formed with annulus gear 22*a* of the first planetary gear stage and first bearing support element 30*a*. Cooling air channel 40*a* is integrally formed with a cooling air intake opening 46*a* of handheld machine tool housing 44*a*. As an alternative, air routing elements implemented as air guide vanes (not illustrated here) are disposed inside cooling air channel 40*a*. However, other air routing elements known to the expert may alternatively be provided as well.

Cooling air intake opening 46*a* is disposed in a region of handheld machine tool housing 44*a* that is facing handle 52*a*. Handheld machine tool housing 44*a* is provided with a total of six cooling air intake openings 46*a* for first flow of cooling air 16*a* for the cooling of gear unit 12*a*, which are integrally formed with cooling air channel 40*a*. Three cooling air intake openings 46*a* are situated within a housing half-shell 90*a* of handheld machine tool housing 44*a* in each case. On a side 92*a* of handheld machine tool housing 44*a* facing away from handle 52*a*, handheld machine tool housing 44*a* has additional cooling air intake openings 94*a* for cooling commutator 84*a* and sliding contact 86*a* implemented as carbon brushes.

To cool gear unit 12*a*, first flow of cooling air 16*a* is produced with the aid of fan wheel 34*a*, 36*a* of cooling air unit 14*a*, and/or electromotor unit 26*a*. In the process, using vacuum pressure generated by fan wheel 34*e*, 36*a*, ambient air is aspirated through cooling air intake openings 46*a* of handheld machine tool housing 44*a* and routed through cooling air channel 40*a* past gear element 18*a*, which is implemented as gearbox cover 20*a* and integrally formed with bearing support element 30*a* and annulus gear 22*a* of the first planetary gear stage. In order to cool gear unit 12*a*, first flow of cooling air 16*a* flows perpendicular to main extension direction 42*a*, via shaft 28*a* and past ball bearing 76*a*. Via convection, gear element 18*a* transmits heat from gear unit 12*a* to first flow of cooling air 16*a* routed past it, which transports the heat away from gear unit 12*a* through cooling air discharge openings 96*a* and out of handheld machine tool housing 44*a*. In the process, shaft 28*a* and ball bearing 76*a* likewise transmit heat to first flow of cooling air 16*a*, via convection, in order to cool gear unit 12*a*. Due to the lubricating grease provided inside gearbox casing 64*a*, a heat equalization takes place inside gearbox casing 64*a* or inside gear unit 12*a*, so that the heat from entire gear unit 12*a* is transmitted to annulus gear 22*a* of the first planetary gear stage and the heat is dissipated away from gear unit 12*a* due to the integral implementation of annulus gear 22*a* of the first planetary gear stage with gear element 18*a* developed as gearbox cover 20*a*, via first flow of cooling air 16*a*.

Furthermore, fan wheel 34*a*, 36*a* generates a second flow of cooling air 98*a*, which is provided for cooling commutator 84*a* and sliding contact 86*a* implemented as carbon brushes. Second flow of cooling air 98*a* is also produced by the vacuum pressure generated with the aid of fan wheel 34*a*, 36*a*, which vacuum pressure aspirates ambient air through additional cooling air intake openings 94*a* of handheld machine tool housing 44*a*. Second flow of cooling air 98*a* is routed along main extension direction 42*a* to provide cooling between commutator 84*a* and sliding contact 86*a* implemented as carbon brushes. In the process, via convection, commutator 84*a* and sliding contact 86*a* implemented as carbon brushes transmit heat to passing second flow of cooling air 98*a*, which transports the heat through cooling air discharge openings 96*a* away from handheld machine tool housing 44*a*. If first flow of cooling air 16*a* and second flow of cooling air 98*a* are added up, then first flow of cooling air 16*a* and second flow of cooling air 98*a* form an overall flow of cooling air 100*a*. First flow of cooling air 16*a* and second flow of cooling air 98*a* jointly may be regarded as 100% of overall flow of cooling air 100*a*. In this context, first flow of cooling air 16*a* constitutes approximately 20% of overall flow of cooling air 100*a*, and second flow of cooling air 98*a* constitutes approximately 80% of the overall flow of cooling air 100*a*.

Figure 3:
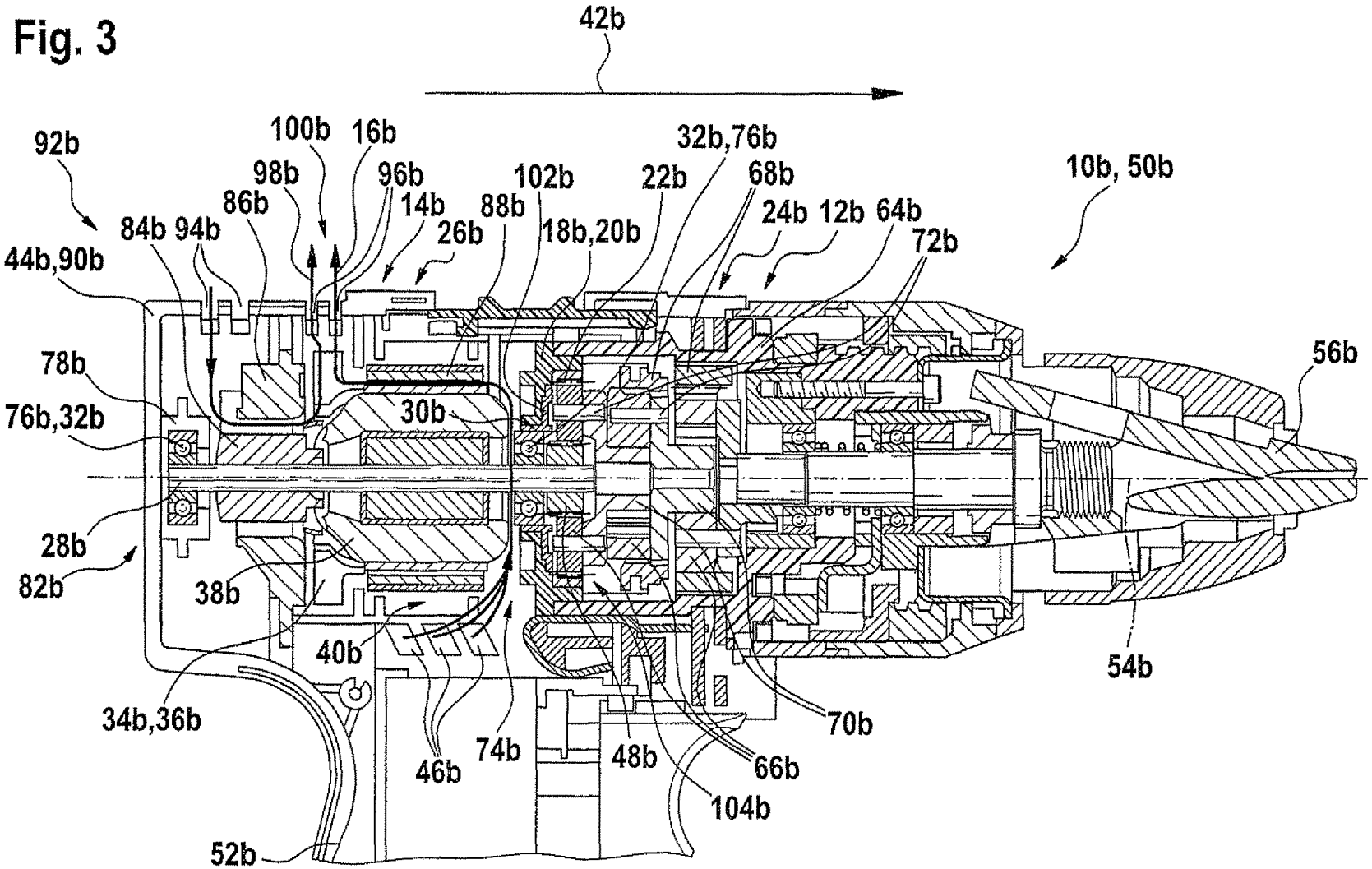
FIG. 3 shows a detail view of the handheld machine tool according to the present invention, showing an open handheld machine tool housing in a schematized illustration.
Figure 4:
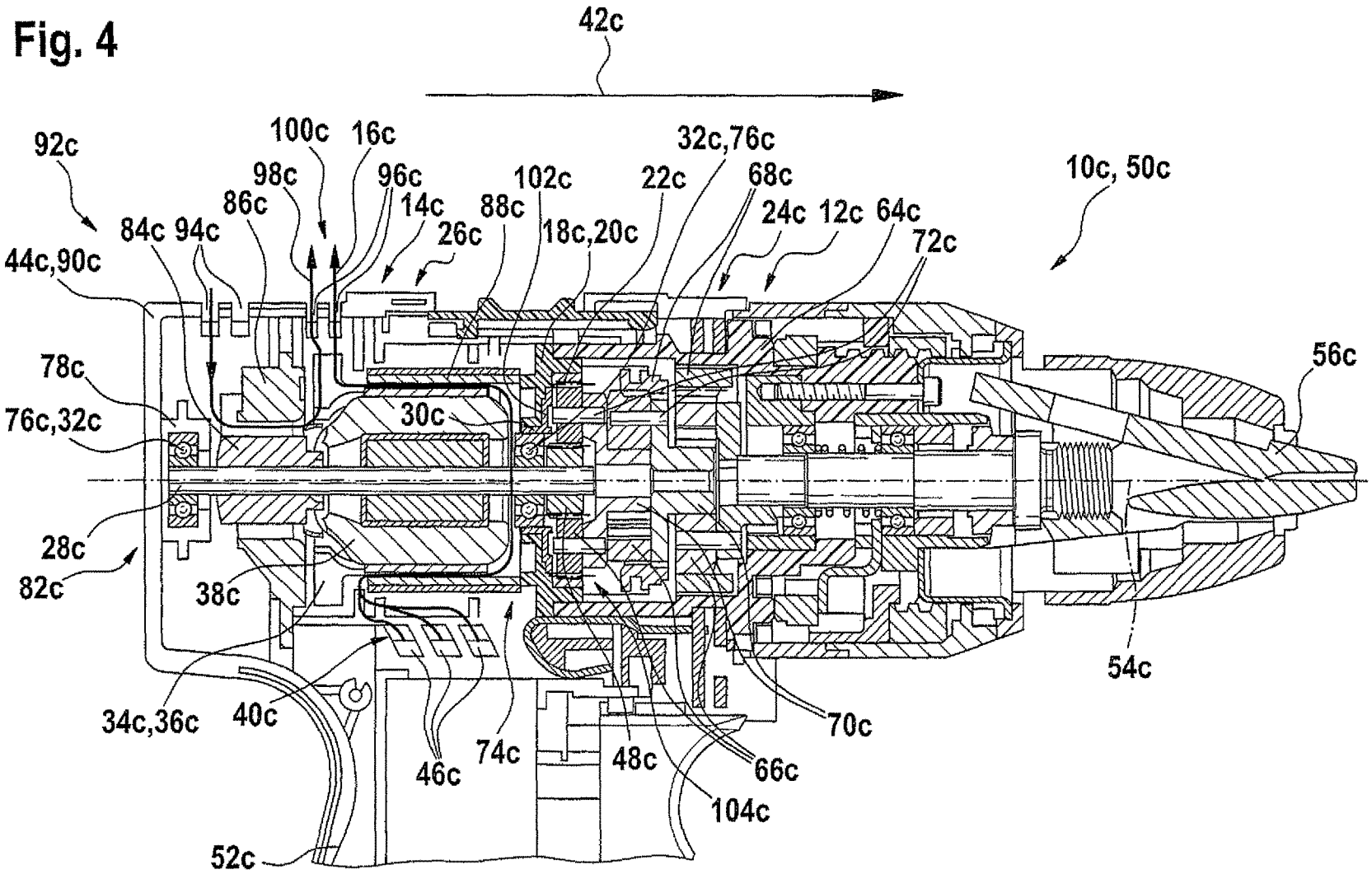
FIG. 4 shows a detail view of another, alternative handheld machine tool according to the present invention, showing an open handheld machine tool housing in a schematized illustration.

FIGS. 3 and 4 show alternative exemplary embodiments. Essentially unchanged components, features and functions are basically denoted by the same reference numerals. To differentiate the exemplary embodiments, the letters a, b and c have been added to the reference numerals of the exemplary embodiments. The following description is essentially restricted to the differences with respect to the exemplary embodiment in FIG. 2, reference being made to the description of the exemplary embodiment in FIG. 2 with regard to components, features and functions that remain unchanged.

FIG. 3 shows a detail view of an alternative handheld machine tool 10*b* according to the present invention, with an open handheld machine tool housing 44*b* in a schematized illustration. Handheld machine tool 10*b* corresponds to a handheld machine tool 10*a* shown in FIG. 1. Handheld machine tool 10*b* includes a gear unit 12*b* implemented as multi-stage planetary gear 24*b*, and a cooling air unit 14*b*. Cooling air unit 14*b* is provided in order to route a first flow of cooling air 16*b* for cooling gear unit 12*b* past a gear element 18*b* of gear unit 12*b* while handheld machine tool 10*b* is in operation. Gear element 18*b* in handheld machine tool 10*b* is developed as gearbox cover 20*b*. Gearbox cover 20*b* is made from plastic. An alternative annulus gear 22*b* of a first planetary gear stage of gear unit 12*b* is formed by a component that is separate from gearbox cover 20*b*.

Furthermore, handheld machine tool 10*b* includes a tool holder 56*b* to accommodate a tool (not illustrated here). Mounted on a side 104*b*, facing tool holder 56*b*, of gearbox cover 20*b* mounted on a gearbox casing 64*b* is a heat-conducting element 102*b*. Heat-conducting element 102*b* is implemented as drawn sheet metal part and adapted to a contour of gearbox cover 20*b*. Heat-conducting element 102*b* is inserted into gearbox cover 20*b* during assembly and is provided in order to transmit, via convection, heat away from gear unit 12*b* to first flow of cooling air 16*b* while handheld machine tool 10*b* is in operation. Toward this end, heat-conducting element 102*b* is integrally formed with an alternative first bearing support element 30*b* of a bearing 32*b* of a shaft 28*b* of electromotor unit 26*b*. First bearing support element 30*b* is sleeve-shaped and extends along a main extension direction 42*b*, in the direction of electromotor unit 26*b*. Thus, first flow of cooling air 16*b* for cooling gear unit 12*b* is routed directly past first bearing support element 30*b* and directly past heat-conducting element 102*b* integrally formed with first bearing support element 30*b*.

FIG. 4 shows a detail view of an alternative handheld machine tool 10*c* according to the present invention, with an open handheld machine tool housing 44*c* in a schematized illustration. Handheld machine tool 10*c* corresponds to a handheld machine tool 10*a* shown in FIG. 1. Handheld machine tool 10*c* includes a gear unit 12*c* implemented as multi-stage planetary gear 24*c*, and a cooling air unit 14*c*. Cooling air unit 14*c* is provided in order to route a first flow of cooling air 16*c* for cooling gear unit 12*c* past a gear element 18*c* of gear unit 12*c* while handheld machine tool 10*c* is in operation. Gear element 18*c* in handheld machine tool 10*c* is developed as gearbox cover 20*c*. Gearbox cover 20*c* is made from a sintered material. As an alternative, for the practical transmission of heat away from gear unit 12*c*, gearbox cover 20*c* is made from a zinc alloy. An annulus gear 22*c* of a first planetary gear stage of gear unit 12*c* is formed by a component that is separate from gearbox cover 20*c*. However, it is also conceivable that annulus gear 22*c* of the first planetary gear stage is implemented in one piece with gearbox cover 20*c*.

In addition, handheld machine tool 10*c* is equipped with an electromotor unit 26*c*. Electromotor unit 26*c* is implemented as so-called open-frame motor, in which the components of electromotor unit 26*c* are individually supported inside handheld machine tool housing 44*c*. A stator 88*c* of electromotor unit 26*c* extends from gearbox cover 20*c* in the direction of a side 82*c* of electromotor unit 26*c* facing away from a tool holder 56*c* of handheld machine tool 10*c*. In a mounted state, stator 88*c* is disposed adjacent to gearbox cover 20*c*. Stator 88*c* thus has direct contact with gearbox cover 20*c*, so that a heat transfer through conduction is able to take place from gearbox cover 20*c* to stator 88*c*, away from gear unit 12*c*. Via first flow of cooling air 16*c*, heat is carried away from stator 88*c* and gearbox cover 20*c*. However, it is also conceivable that electromotor unit 26*c* is implemented as a so-called can motor, in which all components are disposed inside a metal housing. When electromotor unit 26*c* is implemented as so-called can motor, the metal housing rests against gearbox cover 20*c*, so that a heat transfer from gear unit 12*c* is able to take place.

In addition, handheld machine tool 10*c* includes a heat-conducting element 102*c*. Heat-conducting element 102*c* is implemented as a drawn sheet metal part and adapted to a contour of gearbox cover 20*c*. Heat-conducting element 102*b* is provided to transmit heat from gear unit 12*c* to first flow of cooling air 16*c* via convection while handheld machine tool 10*c* is in operation. Toward this end, heat-conducting element 102*c* is integrally formed with a first bearing support element 30*c* of a bearing 32*c* of a shaft 28*c* of electromotor unit 26*c*. First flow of cooling air 16*c* for cooling gear unit 12*c* is routed directly past first bearing support element 30*c* and directly past heat-conducting element 102*c* integrally formed with first bearing support element 30*c*. However, it is also conceivable that bearing support element 30*c* and heat-conducting element 102*c* are implemented in one piece together with gearbox cover 20*c*.

What is claimed is:

1. A handheld machine tool, which is battery-driven, comprising:

a handheld machine tool housing;

a planetary gear unit;

a gearbox casing disposed in the handheld machine tool housing and which accommodates the planetary gear unit;

an electromotor unit, which includes at least one rotor, at least one stator, and at least one shaft, the shaft being supported in the tool housing via at least one bearing, the bearing being disposed in the tool housing on a side of the rotor of the electromotor unit remote from the planetary gear unit; and a fan wheel of a cooling air unit located behind the at least one rotor and the at least one stator on a side of the electromotor unit remote from the planetary gear unit and in front of the at least one bearing;

wherein the cooling air unit is configured to route a flow of cooling air for cooling the planetary gear unit past at least one gear element of the planetary gear unit and perpendicular to a longitudinal axis of the handheld machine tool, wherein the longitudinal axis of the handheld machine tool is defined by the shaft of the electromotor unit, wherein the gear element is a gearbox cover of the gearbox casing, wherein an annulus gear of the planetary gear unit is integrally formed with the gearbox cover.

2. The handheld machine tool of claim 1, wherein the gear element is an annulus gear of the gear unit configured as a planetary gear.

3. The handheld machine tool of claim 1, wherein the electromotor unit has at least one shaft and at least one bearing support element for holding a bearing of the shaft of the electromotor unit.

4. The handheld machine tool of claim 3, wherein the bearing support element is configured at least partially in one piece with the gear element.

5. The handheld machine tool of claim 1, wherein the gear element is produced from a sintered material.

6. The handheld machine tool of claim 1, wherein the gear element is produced from a zinc alloy.

7. The handheld machine tool of claim 1, wherein the electromotor unit includes a fan wheel, which is at least partially integrally formed with the fan wheel of the cooling air unit to generate the flow of cooling air for cooling the gear unit.

8. The handheld machine tool of claim 1, wherein the cooling air unit has at least one cooling air channel, which routes the flow of cooling air along a main extension direction between the rotor and the gear element.

9. The handheld machine tool of claim 8, further comprising:

a handheld machine tool housing, which has at least one cooling air intake opening, which is at least partially formed integrally with the cooling air channel.

10. The handheld machine tool of claim 8, wherein the gear element is disposed along the main extension direction at least partially between a pinion disposed on a shaft of the electromotor unit, and the rotor of the electromotor unit.

11. A handheld machine tool, which is battery-driven, comprising:

a handheld machine tool housing;

a planetary gear unit;

a gearbox casing disposed in the handheld machine tool housing and which accommodates the planetary gear unit;

an electromotor unit including a motor shaft, at least one bearing for supporting the motor shaft, a rotor and a stator, wherein the stator is directly supported in a torque-proof manner inside the handheld machine tool housing;

at least one bearing support element for accommodating the at least one bearing; and a cooling air unit embodied as a fan wheel which is mounted on the motor shaft in a rotationally fixed manner, wherein the cooling air unit is configured to route a flow of cooling air for cooling the planetary gear unit past a gearbox cover of the gearbox casing, and wherein the gearbox cover is disposed along a longitudinal axis at least partially between a pinion disposed on the motor shaft of the electromotor unit and the rotor of the electromotor unit, wherein the gearbox cover is formed integrally with the at least one bearing support element which forms an axial recess in the gearbox cover, wherein an annulus gear of the planetary gear unit is integrally formed with the gearbox cover.

12. The handheld machine tool of claim 2, wherein the annulus gear is integrally formed with a gearbox cover.

13. The handheld machine tool of claim 2, wherein the annulus gear is formed by a component separate from a gearbox cover.

14. The handheld machine tool of claim 1, further comprising:

at least one first cooling air intake opening which is arranged in a region of the handheld machine tool that is facing a handle of the handheld machine tool.

15. The handheld machine tool of claim 14, wherein the at least one first cooling air intake opening is arranged below an axis of rotation of the handheld machine tool.

16. The handheld machine tool of claim 1, further comprising:

at least one cooling air discharge opening which is arranged in a region of the handheld machine tool that is facing away from a handle of the handheld machine tool.

17. The handheld machine tool of claim 16, wherein the at least one cooling air discharge opening is arranged above an axis of rotation of the handheld machine tool.

18. The handheld machine tool of claim 1, further comprising:

at least one first cooling air intake opening which is arranged in a region of the handheld machine tool that is facing a handle of the handheld machine tool; and at least one cooling air discharge opening which is arranged in a region of the handheld machine tool that is facing away from a handle of the handheld machine tool.

19. The handheld machine tool of claim 17, wherein the at least one first cooling air intake opening and the at least one cooling air discharge opening are connected to one another via a first cooling air channel.

20. The handheld machine tool of claim 17, wherein the cooling air unit is configured to route a second flow of cooling air for cooling the at least one shaft of the electromotor unit.

21. The handheld machine tool of claim 20, further comprising:

at least one second cooling air intake opening configured to intake the second flow of cooling air.

22. The handheld machine tool of claim 21, wherein the at least one second cooling air intake opening and the at least one cooling air discharge opening are connected to one another via a second cooling air channel separate from the first cooling air channel.

23. The handheld machine tool of claim 3, further comprising:

a heat-conducting element which is integrally formed with the at least one bearing support element.

24. The handheld machine tool of claim 1, wherein the at least one stator of the electromotor unit is in direct heat conducting contact with the gearbox cover.

25. The handheld machine tool of claim 1, wherein the cooling air unit is located entirely behind the at least one rotor and the at least one stator.

26. The handheld machine tool of claim 11, further comprising:

a heat-conducting element which is integrally formed with the at least one bearing support element.

27. A handheld machine tool, which is battery-driven, comprising:

a handheld machine tool housing;

a planetary gear unit;

a gearbox casing disposed in the handheld machine tool housing and which accommodates the planetary gear unit;

an electromotor unit including a motor shaft, at least one bearing for supporting the motor shaft, a rotor and a stator, wherein the stator is directly supported in a torque-proof manner inside the handheld machine tool housing;

at least one bearing support element for accommodating the at least one bearing; and a cooling air unit embodied as a fan wheel which is mounted on the motor shaft in a rotationally fixed manner, wherein the cooling air unit is configured to route a flow of cooling air for cooling the planetary gear unit past a gearbox cover of the gearbox casing, and wherein the gearbox cover is disposed along a longitudinal axis at least partially between a pinion disposed on the motor shaft of the electromotor unit and the rotor of the electromotor unit, wherein the gearbox cover is formed integrally with the at least one bearing support element which forms an axial recess in the gearbox cover, wherein an annulus gear of the planetary gear unit is formed by a component separate from and in direct contact with the gearbox cover.

28. A handheld machine tool, which is battery-driven, comprising:

a handheld machine tool housing;

a planetary gear unit;

a gearbox casing disposed in the handheld machine tool housing and which accommodates the planetary gear unit;

an electromotor unit including a motor shaft, at least one bearing for supporting the motor shaft, a rotor and a stator, wherein the stator is directly supported in a torque-proof manner inside the handheld machine tool housing;

at least one bearing support element for accommodating the at least one bearing; and a cooling air unit embodied as a fan wheel which is mounted on the motor shaft in a rotationally fixed manner, wherein the cooling air unit is configured to route a flow of cooling air for cooling the planetary gear unit past a gearbox cover of the gearbox casing, and wherein the gearbox cover is disposed along a longitudinal axis at least partially between a pinion disposed on the motor shaft of the electromotor unit and the rotor of the electromotor unit, wherein the gearbox cover is formed integrally with the at least one bearing support element which forms an axial recess in the gearbox cover, a heat-conducting element which is integrally formed with the at least one bearing support element.

* * * * *